US006390237B1

(12) United States Patent
Kim et al.

(10) Patent No.: US 6,390,237 B1
(45) Date of Patent: May 21, 2002

(54) LADDER STEP STOOL WITH LATCH

(75) Inventors: Wan Soo Kim, Hacienda Heights, CA (US); Ping-Jan Chiu, Taichung Hsien (TW); Todd Meyers, Plymouth, MN (US); Franny Chen, San Diego, CA (US)

(73) Assignee: Tricam Industries, Inc., Eden Prairie, MN (US)

( * ) Notice: Subject to any disclaimer, the term of this patent is extended or adjusted under 35 U.S.C. 154(b) by 0 days.

(21) Appl. No.: 09/483,195

(22) Filed: Jan. 14, 2000

(Under 37 CFR 1.47)

Related U.S. Application Data

(60) Provisional application No. 60/115,909, filed on Jan. 14, 1999.

(51) Int. Cl.[7] ..... E06C 1/00

(52) U.S. Cl. ..... 182/161; 182/129; 182/165

(58) Field of Search ..... 182/20, 116, 120, 182/129, 161, 162, 165, 187, 188; 248/238

(56) References Cited

U.S. PATENT DOCUMENTS

| | | | | |
|---|---|---|---|---|
| 2,525,104 A | * | 10/1950 | St. Cyr | 182/165 |
| 4,306,700 A | | 12/1981 | Bell | 248/238 |
| 4,485,892 A | | 12/1984 | Maloney et al. | 182/161 |
| 4,502,564 A | * | 3/1985 | Kummerlin et al. | 182/165 X |
| 4,793,163 A | * | 12/1988 | MacFarlane et al. | 70/2 |
| 5,056,620 A | | 10/1991 | Zumwalt et al. | 182/120 |
| 5,368,347 A | * | 11/1994 | Holtman et al. | 292/257 |
| 5,460,240 A | | 10/1995 | Jones | 182/116 |
| 5,722,507 A | | 3/1998 | Kain | 182/129 |
| 5,762,163 A | | 6/1998 | Kain | 182/161 |
| 5,992,567 A | * | 11/1999 | Chiu | 182/165 X |
| 6,026,933 A | * | 2/2000 | King et al. | 182/165 |
| 6,039,149 A | * | 3/2000 | Bedja et al. | 182/165 X |

FOREIGN PATENT DOCUMENTS

| | | | |
|---|---|---|---|
| EP | 0135666 | 4/1985 | E06C/1/56 |
| GB | 2322897 | 9/1998 | E06C/1/393 |

* cited by examiner

*Primary Examiner*—Bruce A. Lev
(74) *Attorney, Agent, or Firm*—Patterson, Thuente, Skaar & Christensen, P.A.

(57) ABSTRACT

A step stool or ladder has a first frame member and a second frame member. The second frame member folds to a position within the confines of the first frame member to provide a thin, easily stored ladder for use within a household. The first frame member includes a safety hoop at which the user can easily grab while on the step or rung of the ladder or step stool. The frame also includes a cross member which spans a portion of one of the frame members. The ladder or step stool has one or more steps. At least one of the steps is supported primarily by the cross member in its unfolded position in which a user can ascend on the steps of the stool or ladder. One or more other steps may be attached to step which is primarily supported by the cross member. The step that is primarily supported by the cross member includes a latch that has a first curved end which engages the cross member to prevent the step primarily supported by the cross member from disengaging the cross member. The latch has a curved end which engages the cross member. The other end of the latch extends through an opening in the step so that the latch is accessible and visible to the user. The end passing through the opening in the step is provided with a knob that gives further visual cues to the user. The knob also maintains the latch in its position in the opening in the step. The midsection of the latch includes a portion which is bent out of the main plane of the latch. The bent portion serves to limit the amount of travel between the knob and the bent portion. The latch rotates on the portion of the latch between the bent portion and travel limiter and the knob attached to the latch.

24 Claims, 4 Drawing Sheets

LADDER STEP STOOL WITH LATCH

This Application claims benefit of Provisional No. 60/115,909 filed Jan. 14, 1999.

FIELD OF THE INVENTION

This invention relates generally to ladders and step stools, more specifically to ladders and step stools adapted for indoor use.

BACKGROUND OF THE INVENTION

Previously, ladders have been made with little concern for basic safety. Standards have now been implemented that require a constraint which prevents the user from accidentally folding a ladder or step stool during use. The constraint must prevent an unintended fold up or collapse of the ladder or step stool. Such an unintended folding up of the ladder or step stool can result from a user running up to a ladder or walking briskly onto the ladder. The sideways force of the user can cause the ladder or step stool to fold or collapse. In other instances, the user may move to one side or the other and the resultant forces could cause the ladder to collapse or prematurely fold. The results can be very devastating. The user may fall and become injured. The items attached to the ladder or step stool may spill or fall. The items being carried by the user may also spill and fall causing further damage.

Several step stools and ladders now are provided with latches or other constraints. Some latches are for locking a bifurcated step into one of two positions. U.S. Pat. No. 4,485,892 teaches a locking mechanism for a platform stool which is used to lock a bifurcated step into one of two positions. U.S. Pat. No. 5,722,507 teaches a locking mechanism for a ladder which is used to lock a step into one of two positions. U.S. Pat. No. 5,762,163 also teaches locking mechanism for a step stool which is used to lock a bifurcated step into one of two positions. Both U.S. Pat. Nos. 5,722,507 and 5,762,163 are assigned to Cosco, Inc. of Columbus, Ind.

Some latches are for prevention of the collapse or premature folding of a ladder or step stool. The locking mechanisms shown are generally difficult to use. The latches are located below a step on the step stool or ladder and are generally not visible to the user. The user may unfold the step stool or ladder which may engage the lock or latch. However, since the latches or locks are hidden from view folding the ladder or step stool back into its collapsed or storage position may be a problem. Since the lock is not visible, users may become frustrated when trying to fold the ladder or step stool. Sometimes users feel the step stool or ladder is broken and resort to brute force to forcibly fold the step stool or ladder. This ruins the ladder or step stool or causes a loss in the structural integrity of the unit.

What is needed is a step stool or ladder that has a latch that prevents premature or an undesirable folding. What is also needed is a latch that is readily visible when the ladder is in use. Also needed is a ladder which is easy to store within the house.

SUMMARY OF THE INVENTION

The disclosed ladder or step stool has a first frame member and a second frame member. The second frame member folds to a position within the confines of the first frame member to provide a thin, easily stored ladder for use within a household. The first frame member includes a safety hoop at which the user can easily grab while on the step or rung of the ladder or step stool. The frame also includes a cross member which spans a portion of one of the frame members. The ladder or step stool has one or more steps. At least one of the steps is supported primarily by the cross member in its unfolded position in which a user can ascend on the steps of the stool or ladder. One or more other steps may be attached to step which is primarily supported by the cross member.

The step that is primarily supported by the cross member includes a latch that has a first curved end which engages the cross member to prevent the step primarily supported by the cross member from disengaging the cross member. The latch has a curved end which engages the cross member. The other end of the latch extends through an opening in the step so that the latch is accessible and visible to the user. The end passing through the opening in the step is provided with a knob that gives further visual cues to the user. The knob also maintains the latch in its position in the opening in the step. The midsection of the latch includes a portion which is bent out of the main plane of the latch. The bent portion serves to limit the amount of travel between the knob and the bent portion. The latch rotates on the portion of the latch between the bent portion and travel limiter and the knob attached to the latch.

In use, the latch is spaced so that it will engage the cross member with a normal gravitational force. The curved end slips over the cross member. By pushing down on the knob accessible on the outside of the step, the curved end of the latch disengages the cross member. Advantageously, the latch is visible by the user and the knob is provided with a simple written instruction so that the use of the latch is more intuitive. This prevents the user from becoming frustrated and forcibly trying to close the ladder.

DESCRIPTION OF PREFERRED EMBODIMENT

In the following detailed description of the preferred embodiment, reference is made to the accompanying drawings which form a part hereof, and in which are shown by way of illustration specific embodiments in which the invention may be practiced. It is to be understood that other embodiments may be utilized and structural changes may be made without departing from the scope of the present invention.

Figure 1:
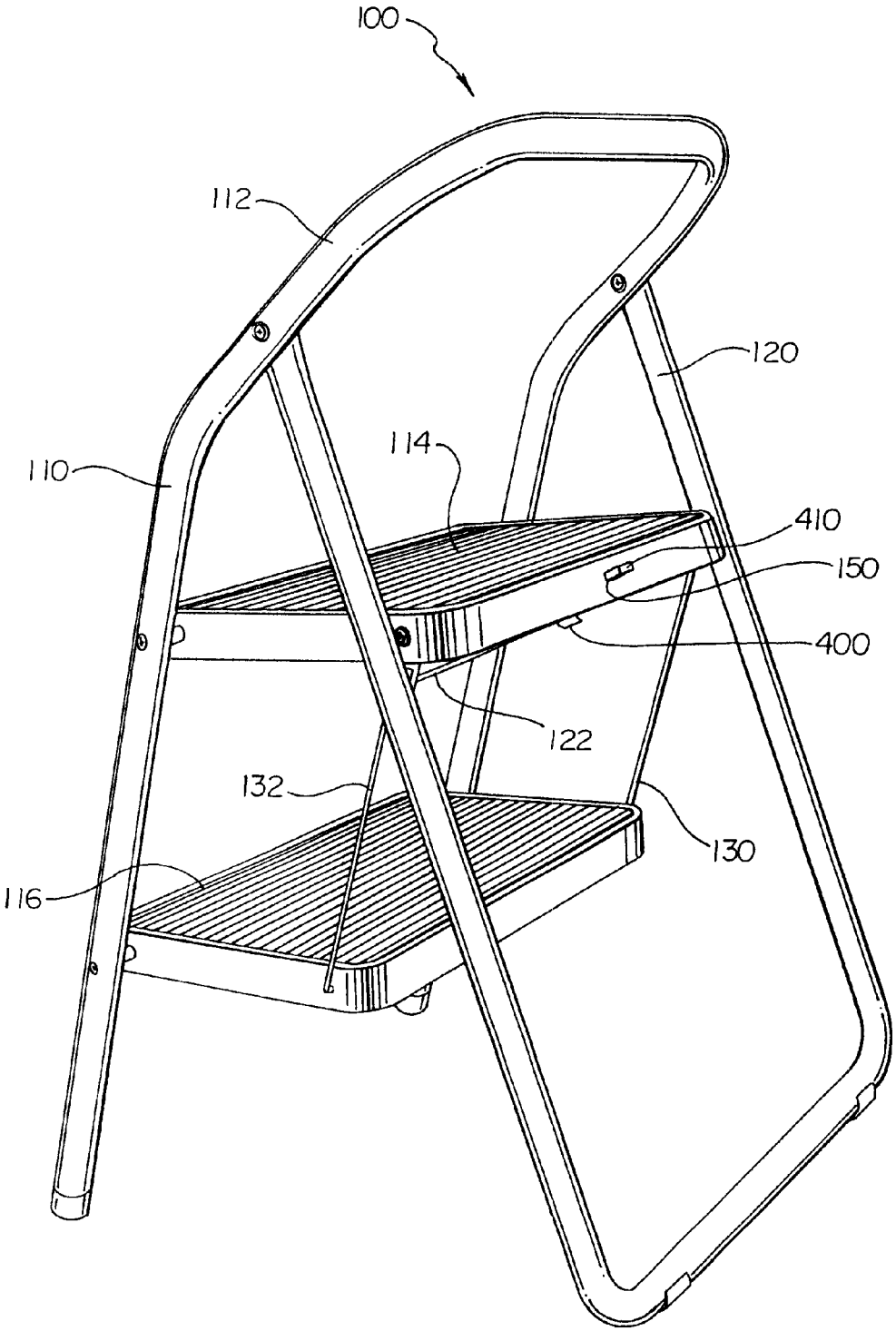
FIG. 1 is a perspective view of a step stool which uses the latch.

FIG. 1 shows a step stool 100. The step stool 100 has a first frame member 110 and a second frame member 120. The first frame member 110 includes a safety hoop 112 which the user can easily grab while on the step or rung of the step stool 100. The step stool 100 includes two rungs or steps 114 and 116 which are pivotally attached to the first frame member 110. The step 114 folds onto a cross member 122. The cross member 122 supports the step 114. The remaining step 116 is attached to a first rod 130 and a second rod 132. The remaining step is supported by the rods 130 and 132.

Step 114 is the step that is primarily supported by the cross member 122. Step 114 includes an opening 150 therein. A latch 400 fits within the opening 150. The latch engages the cross member 122 to prevent the step stool from folding or collapsing unexpectedly during use. It should be noted that this latch is not limited to use in a step stool. The latch 400 could also be used in a ladder with a similar step and cross member in the frame, such as is shown in the related patent application Ser. No. 60/078,648 entitled "LADDER WITH HANDLE FOR CARRYING AND LEDGE FOR HOLDING ITEMS" and filed Mar. 19, 1998. The step stool 100 is used as an example of a ladder or stool that has a step with a latching mechanism 400.

Figure 2:
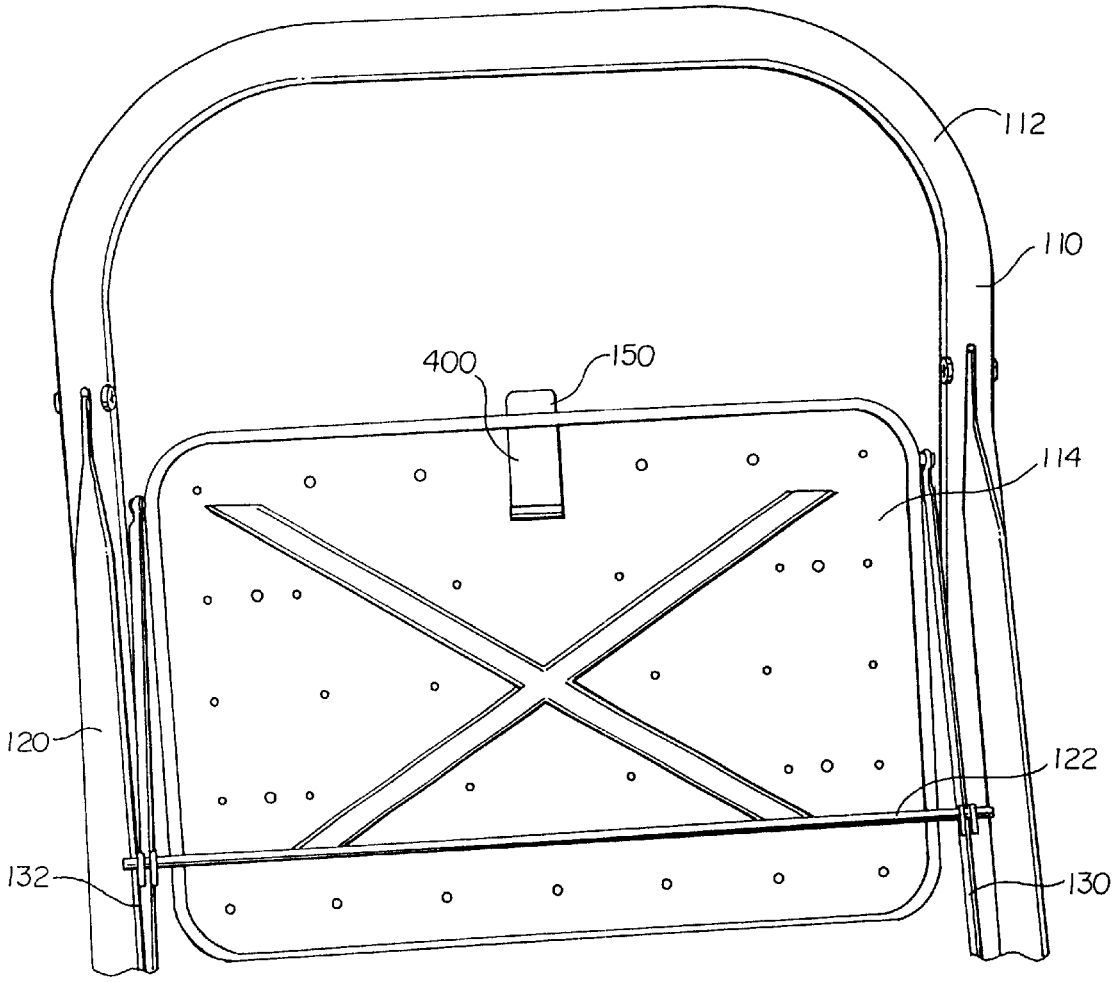
FIG. 2 is a view of a latch and the step of the step stool when the step stool is in a folded position for storage.

FIG. 2 is a view of a latch and the step of the step stool when the step stool is in a folded position for storage. As can be seen, the latch 400 extends through an opening 150 in the edge of the step 114. The latch 400 includes a knob 430 which is attached at one end of the latch 400.

Figure 3:
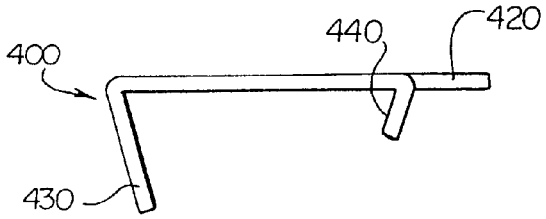
FIG. 3 is a side view of the latch.
Figure 4:
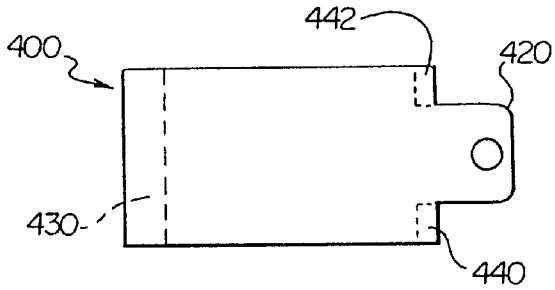
FIG. 4 is a top view of the latch shown in FIG. 4.
Figure 5:
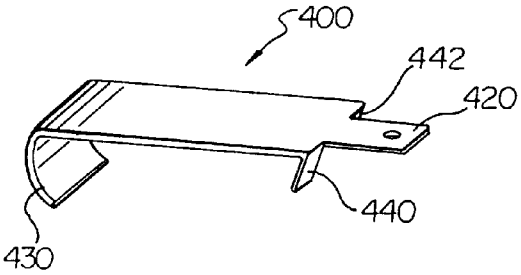
FIG. 5 is a perspective view of the latch without the knob.
Figure 6:
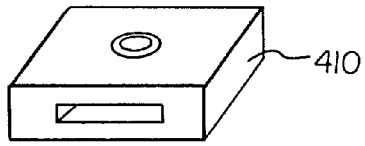
FIG. 6 is a perspective view of the knob that attaches to the latch.

FIGS. 3–6 detail the latch 400. FIG. 3 is a side view of the latch 400. FIG. 4 is a top view of the latch shown in FIG. 3. FIG. 6 is a perspective view of the latch 400. FIG. 6 is a perspective view of the knob that attaches to the latch.

The latch 400 includes a first end 420 and a second end 430. The latch 400 starts from a flat piece of sheet metal. The second end 430 is formed or bent to form a hook which is capable of engaging the cross member 122 of the frame member 120 of the step stool 100 or ladder. The first end 420 is narrower than the main body of the latch 400. The first end 420 is adapted to receive the knob 410 (shown in detail in FIG. 6). Intermediate the first end 420 and the second end 430 is a first tab 440 and a second tab 442. The tabs 440 and 442 serve to limit the distance that the first end 420 can be inserted into the opening 150 in the step 114 of the step stool 100. The tabs 440 and 442 are positioned near the first end 420 in the embodiment shown.

FIG. 5 shows the latch 400 in a perspective view. The latch 400 shown in FIG. 5 has a second end 430 which is slightly more curved than the latch shown in FIG. 3.

Figure 7:
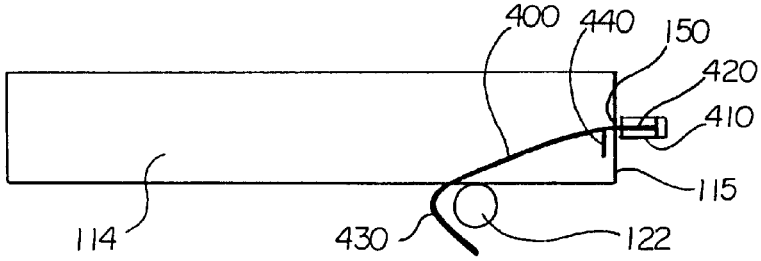
FIG. 7 is a side view of the step, latch and cross member of the step stool.

FIG. 7 is a cut away side view of the step 114. The step 114 is cut away and show the latch 400 engaged with the cross member 122. Frame members 110 and 120 are eliminated from this view for the sake of clarity. FIG. 7 therefore is a side view of the step 114, the latch 400 and the cross member 122 of the step stool 100. The operation of the latch will now be discussed. When the step 114 is folded into a position where the step 114 is supported by the cross member 122, the latch 400 drops over the cross member 122 or engages the cross member 122. Pulling up on the step 114 can not be accomplished since the latch 400, and more specifically the second end 430 of the latch, is engaged with the cross member 122. The knob 410 is placed over the first end 420 after the first end 420 has been passed through the opening 150. The knob 410 and the tabs 440 and 442 serve to limit the amount of travel through which the latch can pass. The portion of the latch between the knob 410 and the tabs 440 and 442 is the pivot point of the latch. The latch 400 pivots on the edge of the opening 150.

After the latch is engaged with the cross member 122 the latch can be disengaged by pushing down on the knob 410 causing the second end of the latch to disengage from the cross member 122. After the latch is disengaged from the cross member 122 the step stool or ladder 100 can be folded into its storage position. The latch knob 410 is typically provided with brief printed instructions which make the operation of the latch more intuitive. For example, the latch knob 410 may carry a designation of push and an arrow. Advantageously, the latch knob and the latch are on the exterior surface 115 of the step 114. This is advantageous since the user can see how to disengage the latch and doesn't have to reach underneath the step 114 in order to unlatch the step and the ladder. This eliminates or greatly reduces the frustration associated with folding up the ladder and disengaging the latch 400.

Figure 8:
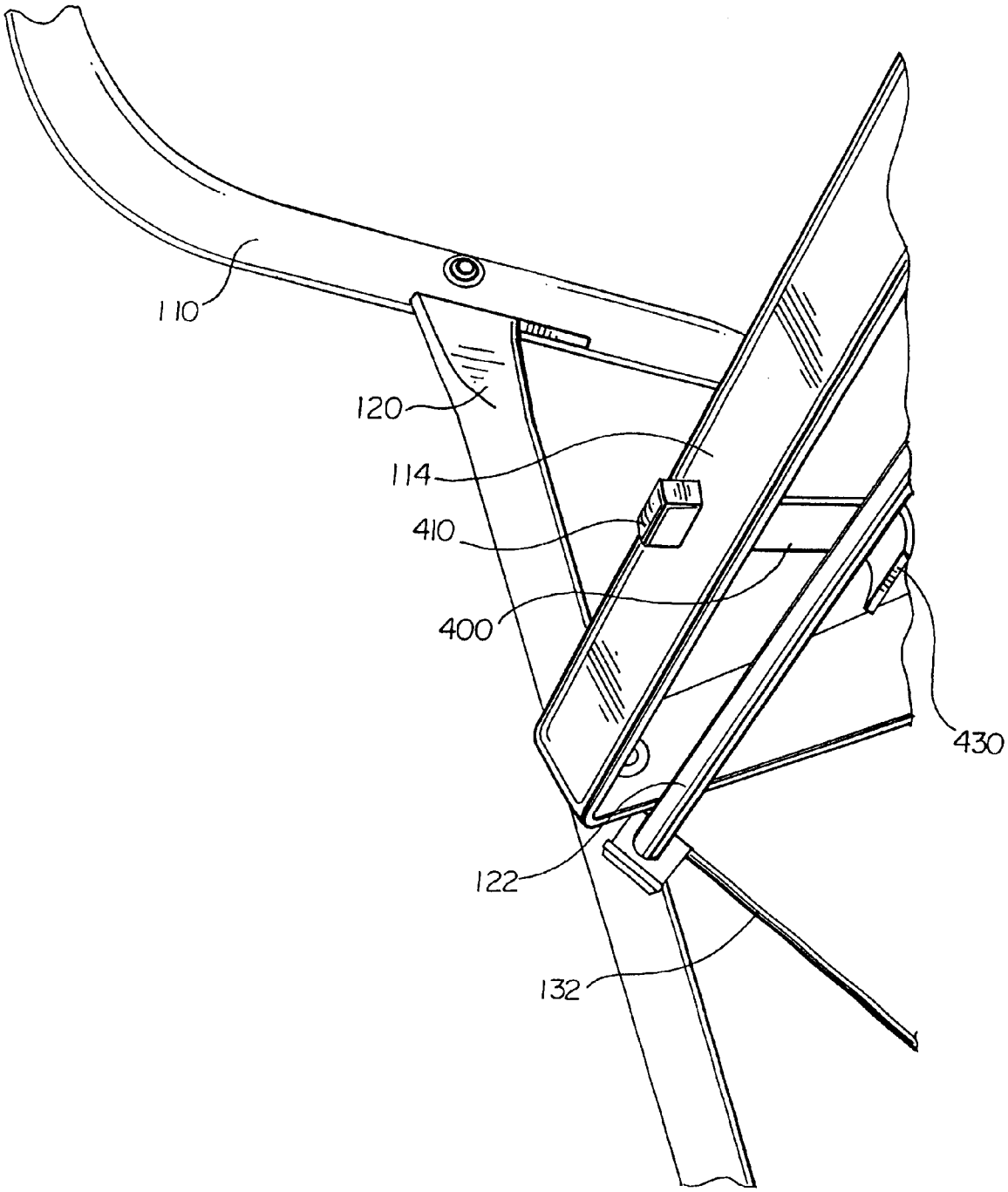
FIG. 8 is a view of a latch engaged with the step where the latch is engaged with the cross member of the frame of the step stool.

FIG. 8 is a view of a latch engaged with the step where the latch is engaged with the cross member of the frame of the step stool. FIG. 8 is a view of a latch 400 engaged with the step 114 where the latch 400 is engaged with the cross member 122 of the frame of the step stool 100. The view shown in FIG. 8 is from the bottom on a normally orientated step stool 100.

Advantageously, the latch is spaced so that it will engage the cross member with a normal gravitational force. The curved end slips over the cross member. The knob is accessible on the exterior surface of the step. By pushing down on the knob on the outside or exterior of the step, the curved end of the latch disengages the cross member. Advantageously, the latch is visible by the user and the knob is provided with a simple written instruction so that the use of the latch is more intuitive. This prevents the user from becoming frustrated and forcibly trying to close the ladder.

It is to be understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What we claim is:

1. A ladder comprising:

a first frame member;

a second frame member further including a cross member;

at least one step pivotally attached to the first frame member having a back edge with an opening therein, said at least one step supported by the cross member of the second frame member; and a latch pivotally attached to the at least one step, wherein the latch is adapted to fit within the opening in the step, said latch having an end which releasably engages the cross member.

2. The ladder of claim 1 wherein the latch has a first end and a second end, said latch further includes a knob positioned on one of the first end and second end of the latch.

3. The ladder of claim 2 wherein the knob is positioned on the exterior portion of the at least one step.

4. The ladder of claim 2 wherein the latch further includes at least one tab positioned between the first end and the second end of the latch, said tab maintaining the position of the latch with respect to the opening in the step.

5. The ladder of claim 2 wherein the tab is a bent portion of sheet metal.

6. The ladder of claim 2 wherein a portion of the latch between the first end and the second end pivots around an edge of the opening in the step.

7. The ladder of claim 1 further comprising steps, at least one of said steps provided with a handle.

8. The ladder of claim 1 further wherein the second frame member has approximately the same width as the first frame member.

9. The ladder of claim 8 further wherein the ladder may be collapsed for storage, second frame member folding to a position within a width of the first frame member.

10. The ladder of claim 1 wherein the ladder may be collapsed for storage, second frame member folding to a position within a width of the first frame member.

11. The ladder of claim 1 wherein a portion of the latch pivots around an edge of the opening in the step.

12. The ladder of claim 1, wherein the latch is gravitationally operable.

13. A ladder comprising:

a first frame member;

a second frame member further including a cross member;

at least one step pivotally attached to the first frame member having a back edge with an opening therein, said at least one step supported by the cross member of the second frame member; and means for latching the ladder in an open position, wherein said means for latching is pivotally mounted to the at least one step.

14. The ladder of claim 13 wherein the means for latching is enabled from a position on the exterior of the at least one step.

15. A step stool comprising:

a first frame member;

a second frame member further including a cross member;

at least one step pivotally attached to the first frame member, said at least one step supported by the cross member of the second frame member; and a latch pivotally attached to a back edge of the at least one step, said latch having an end which releasably engages the cross member.

16. The step stool of claim 15 wherein the latch has a first end and a second end, said latch further includes a knob positioned on one of the first end and second end of the latch, said knob positioned on an exterior portion of the at least one step.

17. The step stool of claim 16 wherein the latch further includes at least one tab positioned between the first end and the second end of the latch, wherein said tab engages the cross member of the step stool.

18. The step stool of claim 16 wherein the tab includes a bent end portion.

19. The step stool of claim 15 wherein the at least one of step further comprises a handle.

20. The step stool of claim 15, wherein the latch is gravitationally operable.

21. A method of operating a step stool, the method comprising:

providing a step stool having a first frame member and a second frame member, wherein the first frame member has a step pivotally attached thereto, wherein the second frame member has a cross member attached thereto and wherein the step has a latch pivotally attached thereto;

pivoting the first frame member away from the second frame member to move the step stool from a closed position to an open position;

pivoting the step with respect to the first frame as the first frame member is pivoted away from the second frame member; and engaging the cross member with a latch pivotally attached to the step to maintain the step stool in the open position.

22. The method of claim 21, wherein the latch engages the cross member using gravitational force.

23. The method of claim 21, and further comprising pivoting the latch with respect to the step to disengage the cross member and thereby permit the step stool to be moved from the open position to the closed position.

24. The method of claim 21, wherein the latch is operable from an exterior of the step.

* * * * *

UNITED STATES PATENT AND TRADEMARK OFFICE

CERTIFICATE OF CORRECTION

PATENT NO. : 6,390,237 B1
DATED : May 21, 2002
INVENTOR(S) : Kim et al.

It is certified that error appears in the above-identified patent and that said Letters Patent is hereby corrected as shown below:

Title page,
Item [57], ABSTRACT,
Line 13, after "to" insert -- the --.

Column 2,
Line 6, after "to" insert -- the --.

Column 3,
Line 45, delete "show" and insert -- shows --.
Line 55, delete "can not" and insert -- cannot --.

Column 6,
Line 7, after "one" delete "of".

Signed and Sealed this

Eighteenth Day of February, 2003

JAMES E. ROGAN
*Director of the United States Patent and Trademark Office*